US012041978B2

(12) United States Patent
Todaro et al.

(10) Patent No.: US 12,041,978 B2
(45) Date of Patent: Jul. 23, 2024

(54) COLLECTION OF BRAS

(71) Applicant: Mast Industries (Far East) Limited, Kowloon (HK)

(72) Inventors: Ursula Giovanna Todaro, Glendale, NY (US); Ka Lai Tam, Shatin (HK); Kwan Yin Yip, Kowloon (HK)

(73) Assignee: Mast Industries (Far East) Limited, Kowloon Bay (HK)

( * ) Notice: Subject to any disclaimer, the term of this patent is extended or adjusted under 35 U.S.C. 154(b) by 51 days.

(21) Appl. No.: 17/932,328

(22) Filed: Sep. 15, 2022

(65) Prior Publication Data

US 2024/0090595 A1 Mar. 21, 2024

(51) Int. Cl.
*A41C 3/00* (2006.01)

(52) U.S. Cl.
CPC ..... *A41C 3/0092* (2013.01)

(58) Field of Classification Search
CPC ..... A41C 3/0092; A41C 3/10; A41C 3/12; A41C 3/0021
USPC ..... 450/57
See application file for complete search history.

(56) References Cited

U.S. PATENT DOCUMENTS

| | | | | |
|---|---|---|---|---|
| 6,986,696 | B1 | 1/2006 | Jagaric et al. | |
| 6,988,931 | B1 | 1/2006 | Martinet et al. | |
| 6,997,775 | B2 | 2/2006 | Jagaric et al. | |
| 7,052,360 | B2 | 5/2006 | Lau | |
| 7,311,583 | B2 | 12/2007 | Jagaric et al. | |
| 7,871,305 | B2 | 1/2011 | Cohen | |
| 8,128,456 | B2 | 3/2012 | Liu | |
| 8,167,678 | B2 | 5/2012 | Castellano | |
| 8,262,433 | B2 | 9/2012 | Castellano | |
| 8,506,349 | B2 | 8/2013 | Sobah-Wilhelm | |
| RE45,838 | E | 1/2016 | MacKinnon | |
| 10,064,437 | B2 | 9/2018 | Brownell et al. | |
| 10,238,155 | B2 | 3/2019 | Braverman | |
| 10,390,571 | B2 | 8/2019 | McKeen et al. | |
| 10,499,692 | B2 | 12/2019 | Braverman | |
| 10,986,881 | B2 * | 4/2021 | Stanton | A41C 3/0064 |
| 2007/0099228 | A1 * | 5/2007 | Chen | C12Q 1/6876 435/6.12 |

(Continued)

FOREIGN PATENT DOCUMENTS

IT AN20110028 A1 8/2012

OTHER PUBLICATIONS

European Search Report in European Patent Application No. 23169724.4, dated Jan. 31, 2024, 8 pages.

*Primary Examiner* — Gloria M Hale
(74) *Attorney, Agent, or Firm* — Andrus Intellectual Property Law, LLP

(57) ABSTRACT

A collection of bras includes a first set of bra cups including a first pair of bra cup sizes, an inner face of each bra cup in the first set having a first padded area having a first shape. The first padded area has a height that is between first and second percentages of a cup height of each bra cup in the first set. A second set of bra cups includes a second pair of bra cup sizes that are larger than the first pair of bra cup sizes relative to a given band size. An inner face of each bra cup in the second set has a second padded area having a second shape that is different from the first shape. The second padded area has a height that is between third and fourth percentages of a cup height of each bra cup in the second set.

20 Claims, 3 Drawing Sheets

(56) References Cited

U.S. PATENT DOCUMENTS

| | | | | |
|---|---|---|---|---|
| 2008/0090491 | A1 | 4/2008 | Liu | |
| 2009/0233524 | A1 | 9/2009 | Cohen | |
| 2010/0022163 | A1* | 1/2010 | Widell | A41C 3/144 450/39 |
| 2010/0041513 | A1* | 2/2010 | Doebele | F16H 61/0403 477/75 |
| 2012/0135667 | A1 | 5/2012 | Chan | |
| 2013/0260639 | A1* | 10/2013 | Lin | A41C 3/105 450/38 |
| 2014/0154947 | A1* | 6/2014 | Braverman | A41C 3/10 450/41 |
| 2016/0029706 | A1* | 2/2016 | Braverman | A41C 3/06 450/55 |
| 2017/0325517 | A1* | 11/2017 | Brownell | A41C 3/144 |
| 2022/0110420 | A1 | 4/2022 | Bonnefoy | |

* cited by examiner

COLLECTION OF BRAS

FIELD

The present disclosure relates to bras, and more specifically to "push up" bras that provide lift to a wearer's breasts.

BACKGROUND

U.S. Pat. No. 6,986,696, which is incorporated herein by reference in its entirety, discloses a method of manufacturing a bra pad having a thicker summit area, as well as the pad itself, which includes holding a sheet of resilient and formable material of uniform thickness, such as thermoplastic foam, and forming the sheet to have a graduated thicker summit area corresponding to each summit of a bra or bra-like garment for including the pad, and a surrounding thinner area. Each pad thus has a thicker summit area for extending over the summits of the breasts.

U.S. Pat. No. 6,988,931, which is incorporated herein by reference in its entirety, discloses a method for making a pad including pre-laminating a pair of foam sheets with fabric, shaving the foam from a first end of each foam sheet so that it gradually becomes thinner until only fabric is existent at an opposite second end, attaching the fabric and foam assemblies via the fabric at the second ends to form a pre-form assembly, molding the pre-form assembly to form a pair of cup-shaped members, and trimming off material around the cup-shaped members to form a pair of pads. The method further includes molding a second sheet of fabric, enclosing a formed pad in the second sheet of fabric, and trimming off the second fabric material around the edges of the formed pad. The formed pad is thickest at the bottom for support and becomes thinner until there is only fabric along the neckline to blend in with the skin of the wearer.

U.S. Pat. No. 6,997,775, which is incorporated herein by reference in its entirety, discloses a method of manufacturing a bra pad having a thicker summit area, as well as the pad itself, which includes holding a sheet of resilient and formable material of uniform thickness, such as thermoplastic foam, and forming the sheet to have a graduated thicker summit area corresponding to each summit of a bra or bra-like garment for including the pad, and a surrounding thinner area. Each pad thus has a thicker summit area for extending over the summits of the breasts.

U.S. Pat. No. 7,052,360, which is incorporated herein by reference in its entirety, discloses a molded breast cup for a brassiere including a molded cup form and laminated structure of a first panel of a flexible foam material and a second panel of flexible material. The first and second panels are substantially coextensive to each other and define a breast cup perimeter shape. The first panel of flexible foam material is of varying thickness, providing a zone of greater thickness at a region or regions away from the perimeter at a general area where the nipple of the wearer of the brassiere will normally be positioned in order to provide greater thickness of material or density of material at such regions to reduce the visibility of the nipple through the brassiere.

U.S. Pat. No. 7,311,583, which is incorporated herein by reference in its entirety, discloses a method of manufacturing a breast-covering garment pad having a thicker summit area, as well as the pad itself, which includes holding a sheet of resilient and formable material of uniform thickness, such as thermoplastic foam, and forming the sheet to have a graduated thicker summit area corresponding to each breast summit of the pad or a garment including the pad, and a surrounding thinner area. Each pad thus has a thicker summit area for extending over the nipples the breasts.

U.S. Pat. No. 7,871,305 discloses a range of push up bras. The range comprises different bra cup sizes, and offers a different amount of padding for different cup sizes in the same range. The different padding provided facilitates a better tailoring of the bra to the body type of the wearer. The padding occupies a decreasing area of the cup as the cup size increases. The center of the padding is also gradually lowered with increasing cup size.

U.S. Patent Application Publication No. 2022/0110420, which is incorporated herein by reference in its entirety, discloses a closure portion for a brassiere including an inner face configured to contact a wearer's skin while the bra is worn. An outer face faces away from the wearer's skin while the brassiere is worn. A first end is attached to a wing of the brassiere. A free second end is opposite the first end. The eyes on the outer face of the closure portion are arranged in a first column of eyes next to a second column of eyes and a third column of eyes next to the second column of eyes. A first lateral spacing is provided between the first and second columns of eyes, which first lateral spacing is different from a second lateral spacing between the second and third columns of eyes. A brassiere with such a closure portion is also provided according to the present disclosure.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

According to one example of the present disclosure, a collection of bras comprises a first set of bra cups comprising at least a first pair of bra cup sizes, an inner face of each bra cup in the first set of bra cups having a first padded area having a first shape, the first padded area having a height that is at least a first percentage of a cup height of each bra cup in the first set of bra cups. The collection comprises a second set of bra cups comprising at least a second pair of bra cup sizes that are larger than the first pair of bra cup sizes relative to a given band size, an inner face of each bra cup in the second set of bra cups having a second padded area having a second shape that is different from the first shape, the second padded area having a height that is at least a second percentage of a cup height of each bra cup in the second set of bra cups. The second percentage of the cup height is less than the first percentage of the cup height, and the height of the second padded area on the inner face of each bra cup in the second set of bra cups is less than the first percentage of the cup height.

According to one example, the collection further comprises a third set of bra cups comprising at least a third pair of bra cup sizes that are larger than the second pair of bra cup sizes relative to the given band size, an inner face of each bra cup in the third set of bra cups having a third padded area having a third shape that is different from the first and second shapes, the third padded area having a height that is at least a third percentage of a cup height of each bra cup in the third set of bra cups. The third percentage of the cup height is less than the second percentage of the cup height, and the height of the third padded area on the inner face of each bra cup in the third set of bra cups is less than the second percentage of the cup height.

According to one example, each bra cup in the first set of bra cups has a curved bottom edge, a neckline edge, and an underarm edge and the first padded area has a lower edge that is offset from and follows the curved bottom edge, an outer edge that is offset from and follows the underarm edge, and a convex upper edge connecting the lower edge and the outer edge of the first padded area.

According to one example, each bra cup in the second set of bra cups has a curved bottom edge, a neckline edge, and an underarm edge and the second padded area has a lower edge that is offset from and follows the curved bottom edge, an upper edge that is substantially straight, and two convex corners connecting the lower edge to the upper edge on either side of the second padded area.

According to one example, each bra cup in the third set of bra cups has a curved bottom edge, a neckline edge, and an underarm edge and the third padded area has a lower edge that is offset from and follows the curved bottom edge, a concave upper edge that has a smaller radius of curvature than a radius of curvature of the lower edge, and two convex corners connecting the lower edge to the upper edge on either side of the third padded area.

According to one example, the first percentage is about 50%, the second percentage is about 40%, and the third percentage is about 20. More particularly, the first percentage is between about 53% and about 56%, the second percentage is between about 40% and about 42%, and the third percentage is between about 21% and about 23%.

According to another example, a collection of bras comprises a first set of bra cups comprising at least a first pair of bra cup sizes, an inner face of each bra cup in the first set of bra cups having a first padded area having a first shape, the first padded area having a height that is between a first percentage and a second percentage of a cup height of each bra cup in the first set of bra cups. The collection comprises a second set of bra cups comprising at least a second pair of bra cup sizes that are larger than the first pair of bra cup sizes relative to a given band size, an inner face of each bra cup in the second set of bra cups having a second padded area having a second shape that is different from the first shape, the second padded area having a height that is between a third percentage and a fourth percentage of a cup height of each bra cup in the second set of bra cups. The third percentage of the cup height is less than the second percentage of the cup height.

According to one example, the collection further comprises a third set of bra cups comprising at least a third pair of bra cup sizes that are larger than the second pair of bra cup sizes relative to the given band size, an inner face of each bra cup in the third set of bra cups having a third padded area having a third shape that is different from the first and second shapes, the third padded area having a height that is between a fifth percentage and a sixth percentage of a cup height of each bra cup in the third set of bra cups. The fifth percentage of the cup height is less than the fourth percentage of the cup height.

According to one example, there is a difference of at least 10% between the second percentage and the third percentage.

According to one example, there is a difference of at least 15% between the fourth percentage and the fifth percentage.

According to one example, the first and second percentages are between about 50% and about 60%, the third and fourth percentages are between about 40% and about 50%, and the fifth and sixth percentages are between about 20% and about 30%. More particularly, the first percentage is about 56%, the second percentage is about 53%, the third percentage is about 42%, and the fourth percentage is about 40%.

According to any of the above examples, the first pair of bra cup sizes comprises an A cup size and a B cup size, the second pair of bra cup sizes comprises a C cup size and a D cup size, and the third pair of bra cup sizes comprises a DD cup size and a DDD cup size.

According to any of the above examples, the first and second padded areas project from the inner face of the respective bra cup in the first and second sets of bra cups.

BRIEF DESCRIPTION OF THE DRAWINGS

The present disclosure is described with reference to the following Figures. The same numbers are used throughout the Figures to reference like features and like components.

DETAILED DESCRIPTION

Figure 1:
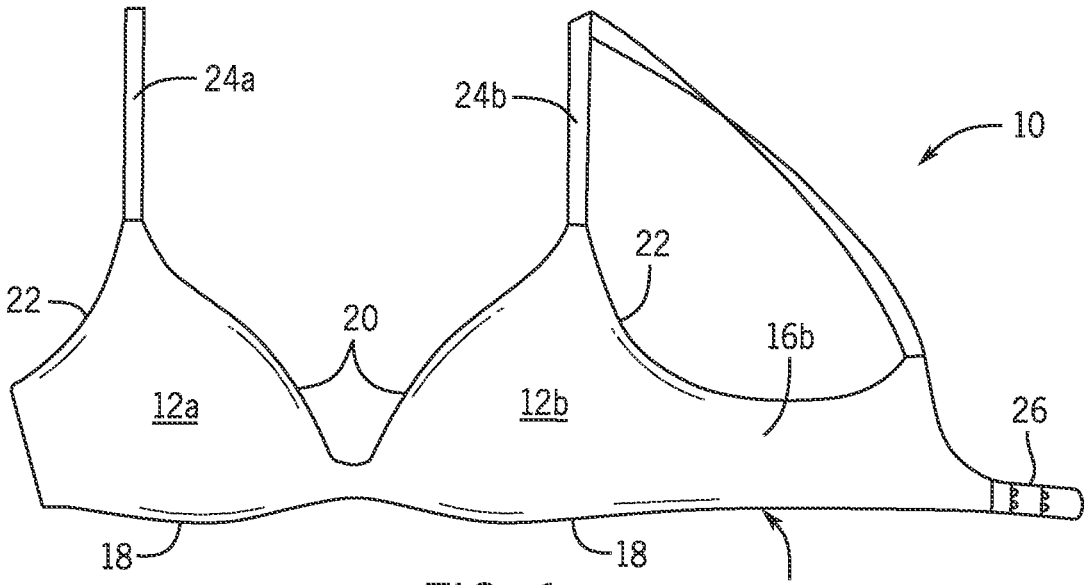
FIG. 1 illustrates an outer face of an exemplary bra in a collection of bras according to the present disclosure.

Before any embodiments of the invention are explained in detail, it is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

Unless otherwise specified or limited, the phrases "at least one of A, B, and C," "one or more of A, B, and C," and the like, are meant to indicate A, or B, or C, or any combination of A, B, and/or C, including combinations with multiple instances of A, B, and/or C. Likewise, unless otherwise specified or limited, the terms "mounted," "connected," "linked," "supported," and "coupled" and variations thereof are used broadly and encompass both direct and indirect mountings, connections, supports, and couplings. Further, unless otherwise specified or limited, "connected" and "coupled" are not restricted to physical or mechanical connections or couplings.

As used herein, unless otherwise limited or defined, discussion of particular directions is provided by example only, with regard to particular embodiments or relevant illustrations. For example, discussion of "top," "bottom," "front," "back," "left," "right," "lateral" or "longitudinal" features is generally intended as a description only of the orientation of such features relative to a reference frame of a particular example or illustration. Correspondingly, for example, a "top" feature may sometimes be disposed below a "bottom" feature (and so on), in some arrangements or embodiments. Additionally, use of the words "first," "second", "third," etc. is not intended to connote priority or importance, but merely to distinguish one of several similar elements from another. Unless otherwise specified or limited, the word "about" means±10%. The phrase "at least about" means greater than or equal to the value recited ±10%.

Reference will be made herein to the "inner face" of a bra cup or to the "outer face" of a bra cup. The inner face is the surface that faces toward and touches a wearer's skin when the bra is worn as intended. The outer face is the surface that faces outwardly away from the wearer when then bra is worn as intended.

Bra cup size is defined in various ways across different styles, brands, and/or manufacturers. In general, bra cup size is related to and determined from bra band size. In one example, band size is measured around a wearer's torso, with a tape measure across her shoulder blades in the back and draped across the top of her breasts in the front. The measurement is directly translated to band size if even, or rounded up to the next even number if odd. In another example, band size is measured around the circumference of the wearer's torso just below her breasts. The measurement is directly translated to band size if even, or rounded up to the next even number if odd. In still another example, band size is determined by measuring the circumference of the wearer's torso just below her breasts and adding 4 inches (about 10.2 cm) if the measurement is even, or 5 inches (about 12.7 cm) if the measurement is odd, to arrive at band size. In any example for determining band size, cup size is then based on a difference between (a) a measurement around the fullest part of the wearer's bust and (b) her band size. To measure the fullest part of her bust, the measuring tape is wrapped around the circumference of her torso, parallel to the floor, over the fullest part of her breasts. A difference between the bust size measurement and the band size (regardless of how it was determined) is then correlated to a cup size. In most cases, an "A" cup will fit a wearer with 1 inch (about 2.5 cm) of difference between bust and band size; a "B" cup will fit a wearer with 2 inches (about 5.1 cm) of difference between bust and band size; a "C" cup will fit a wearer with 3 inches (about 7.6 cm) of difference between bust and band size; etc.

Note that internationally, the letters A, B, C, D, etc. are not universally used to denote cup size. For instance, by way of non-limiting example, cup size DD is sometimes referred to as E. Cup size DDD is sometimes referred to as F, and sometimes referred to as E. The present disclosure will henceforward describe bra sizing in terms of inches and A, B, C, D, etc. according to United States sizing standards. However, it should be understood that the present disclosure and claims apply equally to metric measurements and international variations on band and cup sizing.

Further, style (e.g., sport versus lingerie, demi versus balconette, padded versus unlined), brand, and manufacturer can all affect bra size. That is, a wearer may wear a 34B of a particular style of bra from a given brand, but a 32C of a different style from the same brand; a wearer may wear a 34B of a particular style of bra from a given brand, but a 34C of the same style from a different brand; etc. The present disclosure and claims are not limited to any particular brand or manufacturer's bra size chart or method of defining band or cup size.

Finally, as those having ordinary skill in the art know, and as should be apparent from the above description of how cup size is calculated, a cup of a given size (e.g., B) associated with a given band size (e.g., 34) is not in actuality the same true size (e.g., dimensions and/or volume) as a cup of the same given size (e.g., B) associated with a different band size (e.g., 36). For example, a cup in a size 34B bra may be roughly 5 inches in height, while a cup in a size 36B bra may be roughly 5⅝ inches in height, and a cup in a size 38B bra may be roughly 6⅜ inches in height. This is because the cup size is calculated from the difference between bust size and band size, and as band size increases, but the difference between bust size and band size stays the same, the volume of the cup must increase to hold more breast tissue.

Figure 5:
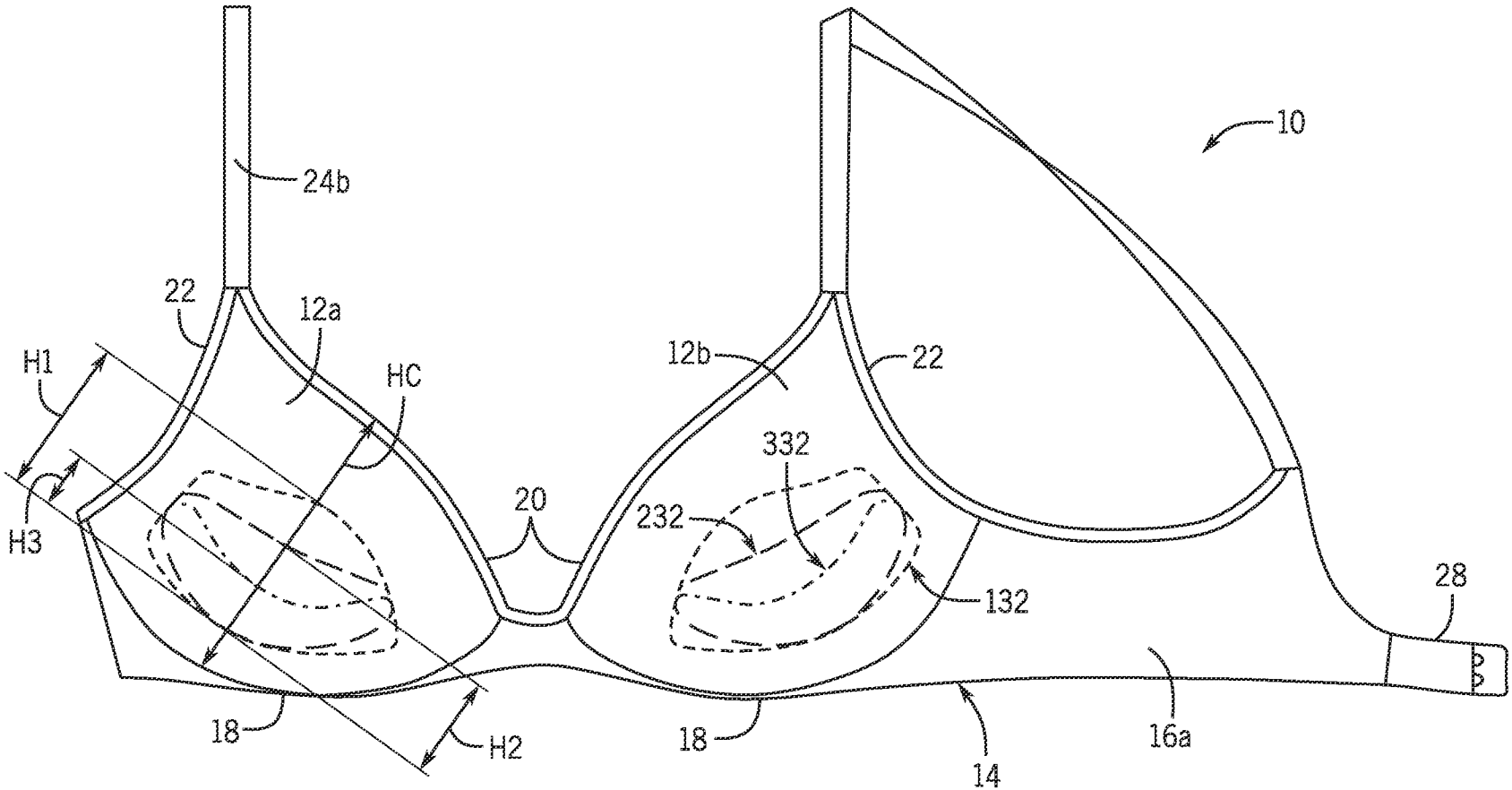
FIG. 5 illustrates an inner face of a portion of a bra, with an outline of a padded area of each of the exemplary bras in the first, second, and third sets of bras shown thereon.

FIG. 1 illustrates exemplary bra 10 in a collection of bras according to the present disclosure. FIG. 1 shows an outer face of the bra 10 (i.e., what would be seen when the bra 10 is worn by a wearer). The bra 10 includes a pair of bra cups 12*a*, 12*b*. The bra 10 also includes a chest band 14 configured to encircle and lay against a wearer's ribcage. The chest band 14 comprises a wing 16*b*. Although only one wing 16*b* is shown in FIG. 1, those having ordinary skill in the art would understand that another wing 16*a* (see FIG. 5) extends from the other bra cup 12*a*. Each bra cup 12*a*, 12*b* has a curved bottom edge 18, a neckline edge 20, and an underarm edge 22. The bra 10 also includes straps 24*a*, 24*b*, an eye closure part 26, and a hook closure part 28 (FIG. 5). As is known, the hook closure part 28 can be connected to the eye closure part 26 to secure the distal ends of the wings 16*a*, 16*b* together and thus to secure the chest band 14 around the wearer's ribcage. In other examples, the bra 10 is strapless and/or has stretchy wings 16*a*, 16*b* that allow a wearer to put on and take off the bra 10 by pulling it over her head. In still another example, the bra 10 is a front-close bra, with one back band extending from the outer edge of one bra cup 12*a* to the outer edge of the other bra cup 12*b* and a center-front closure between the two bra cups 12*a*, 12*b*. Various other styles and constructions of bras are contemplated within the scope of the present disclosure.

Figure 2:
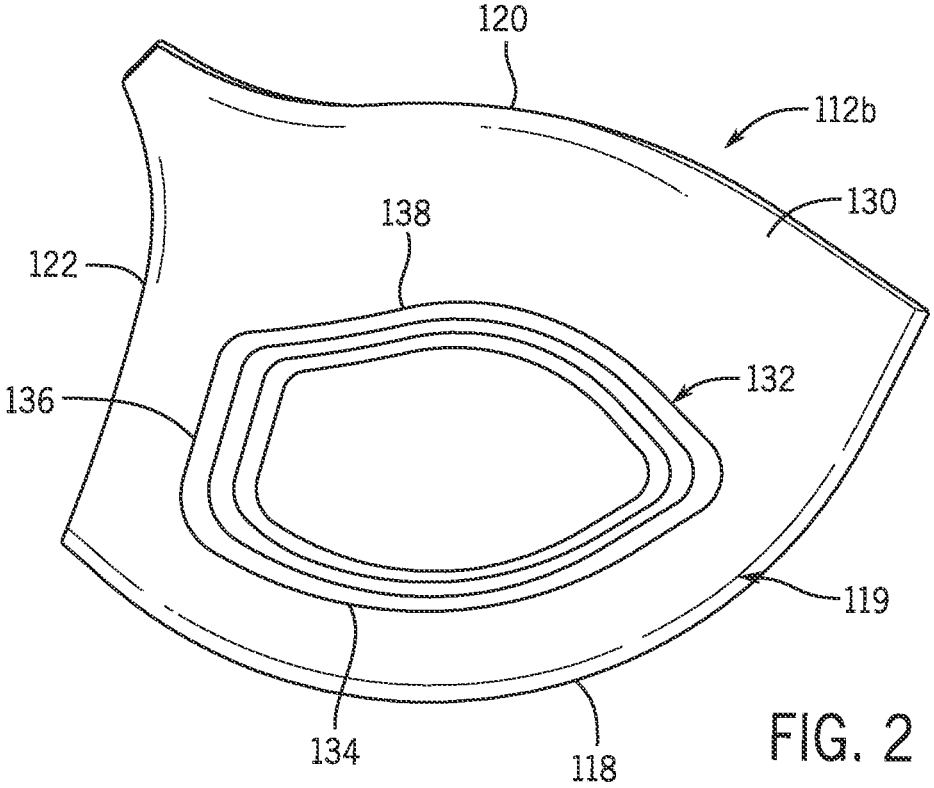
FIG. 2 illustrates the inner face of a bra cup of an exemplary bra in a first set of bras in the collection.
Figure 3:
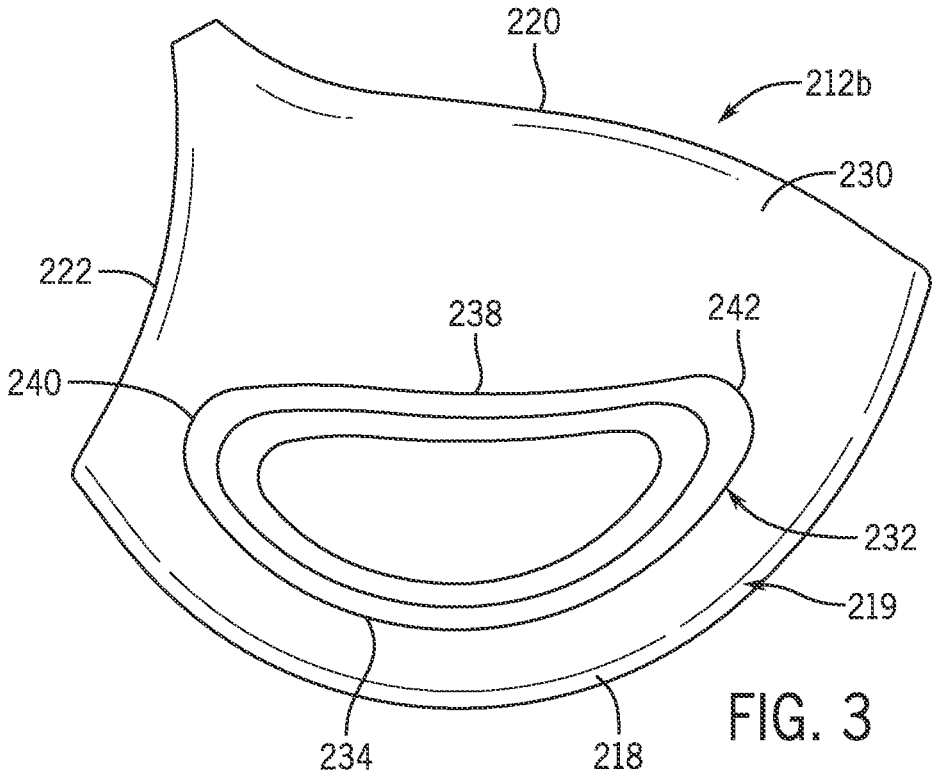
FIG. 3 illustrates the inner face of a bra cup of an exemplary bra in a second set of bras in the collection.
Figure 4:
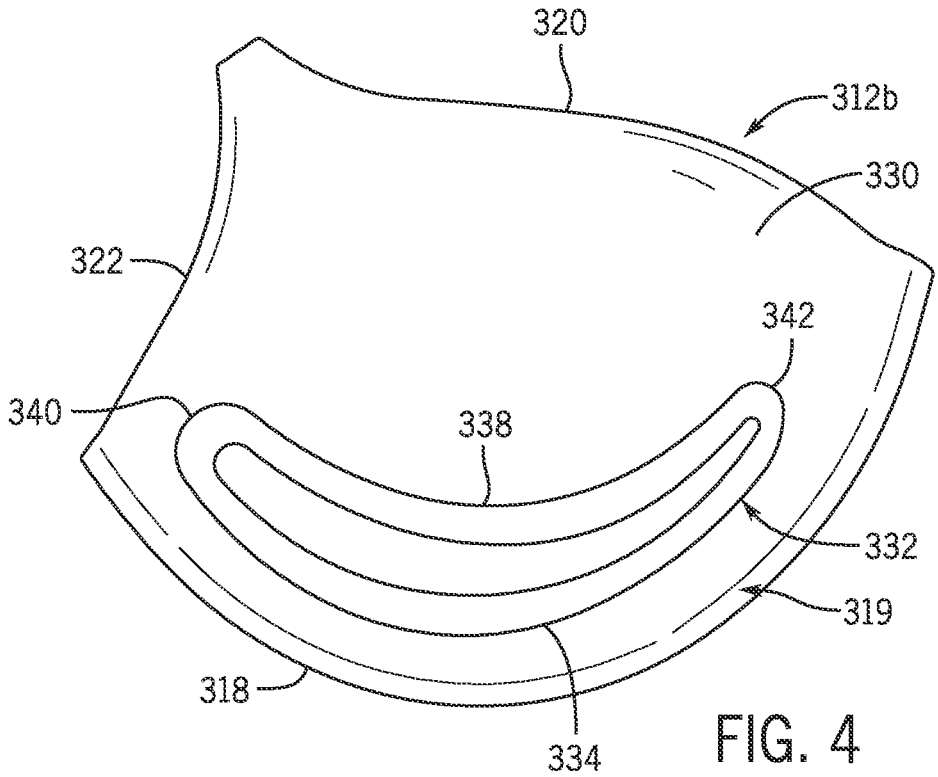
FIG. 4 illustrates the inner face of a bra cup of an exemplary bra in a third set of bras in the collection.

As noted, the bra 10 is one of a collection of bras. In other words, there are various bras having similar construction and style as part of the collection, but which are provided in various band and cup sizes. The collection of bras includes at least a first set of bra cups comprising at least a first pair of bra cup sizes, a second set of bra cups comprising at least a second pair of bra cup sizes, and a third set of bra cups comprising at least a third pair of bra cup sizes. As noted above, "size" is not intended to refer to the true size (e.g., dimensions or volume) of the bra cups 12*a*, 12*b*, but rather to the alphabetical size of the bra cup as per the discussion of bra sizing provided hereinabove. By way of example, the inner face 130 of a bra cup 112*b* in the first set of bra cups is shown in FIG. 2, in which the first pair of bra cup sizes includes an A cup size and a B cup size; the inner face 230 of a bra cup 212*b* in the second set of bra cups is shown in FIG. 3, in which the second pair of bra cup sizes includes a C cup size and a D cup size; and the inner face 330 of a bra cup 312*b* in the third set of bra cups is shown in FIG. 4, in which the third pair of bra cup sizes includes a D cup size and a DD cup size. Additional sets of bra cups (e.g., fourth, fifth) are also contemplated within the scope of the present disclosure.

As noted, FIG. 2 shows the inner face 130 of an exemplary bra cup 112*b* in the first set of bra cups, which comprises at least a first pair of bra cup sizes. In one example, the pair of bra cup sizes comprises an A cup size and a B cup size. However, the first pair of bra cup sizes could instead include a AA cup size and an A cup size; a AA cup size, an A cup size, and a B cup size; a B cup size and a C cup size; etc. The bra cup 112*b* has a curved bottom edge 118, a neckline edge 120, and an underarm edge 122. As shown, the inner face 130 of the bra cup 112*b* has a first padded area 132 having a first shape. The first padded area 132 has a lower edge 134 that is offset from and follows the curved bottom edge 118 of the bra cup 112*b*, an outer edge 136 that is offset from and follows the underarm edge 122 of the bra cupb 112*b*, and a convex upper edge 138 connecting the lower edge 134 and the outer edge 136 of the first padded area 132. The lower edge 134 of the first padded area 132 may be offset from the curved bottom edge 118 of the bra cup 112*b* by about 0.5-0.75 inch. The outer edge 136 of the first padded area 132 may be offset from the underarm edge 122 of the bra cup 112*b* by about 0.5-1 inch. The convex upper edge 138 of the first padded area 132 may generally follow the shape of the neckline edge 120 and may be offset by about 1-3 inches therefrom, measured along the axis shown in FIG. 5.

Referring additionally to FIG. 5, according to the present disclosure, the first padded area 132 has a height H1 that is at least a first percentage of a cup height HC of the bra cup 112*b*. The heights H1 and HC are measured along the axis shown in FIG. 5, which axis is more or less parallel to the underarm edge 122 of the bra cup 112*b*, although other axes could be used in other examples. The height measurements are taken generally midway across the bra cup 112*b*, at the location where the first padded area 132 has its maximum height. In one example, the first percentage is about 50%. In a more specific example, the first percentage is between about 53% and about 56% of the height HC of the first bra cup 112*b*. In one example, the height HC of the bra cup 112*b* used in the denominator to calculate the first percentage excludes the flange 119 (FIG. 2) at the curved bottom edge 118 (i.e., the portion of the bra cup 112*b* to which the underwire is attached). In other examples, the height HC of the bra cup 112*b* in the denominator includes the flange 119. The height of the bra cup 112*b* and the height of the first padded area 132 can both be measured in plan, or can instead be measured taking into account the curvature of one or both of the first padded area 132 and the bra cup 112*b*. In one example in which the measurements take into account the curvature of the bra cup 112*b*, the height HC of the bra cup 112*b* is measured on the outer face of the bra cup 112*b*, but in another example the height HC is measured on the inner face 130 of the bra cup 112*b*.

Although only the left bra cup 112*b* is described herein, it should be understood that the right bra cup is a mirror image.

Further, according to the present disclosure, the inner face 130 of each bra cup in the first set of bra cups has the first padded area 132 having the first shape and the first padded area 132 has a height that is at least a first percentage of a cup height HC of each bra cup in the first set of bra cups. Each bra cup in the first set of bra cups has a curved bottom edge 118, a neckline edge 120, and an underarm edge 122. The first padded area 132 has a lower edge 134 that is offset from and follows the curved bottom edge 118, an outer edge 136 that is offset from and follows the underarm edge 122, and a convex upper edge 138 connecting the lower edge 134 and the outer edge 136 of the first padded area 132. That is, each bra cup in the first set of bra cups, whether it be (for example) an A cup or a B cup, has the first padded area 132 having the first shape, across all band sizes. In each cup in the first set of bra cups, the first padded area 132 has a height that is at least the first percentage of the cup height HC of the bra cup. This means that in an A size cup associated with a given band size, the actual measurement of the height H1 of the first padded area 132 might be smaller than the actual measurement of the height of the first padded area 132 in a B size cup associated with the same band size, due to the difference in overall height of an A cup versus a B cup when used with the same band size.

It should be noted that the first percentage of the height HC of the bra cup 112*b* need not be the same for all cup and/or band sizes forming the first set of bra cups in the collection. For example, the first padded area 132 may have a height H1 that is 56% of the height of a 34A cup, but 55% of the height of a 36A cup. The first padded area 132 may have a height that is 53% of the height of a 36b cup, but 54% of a height of a 38B cup.

FIG. 3 shows the inner face 230 of an exemplary bra cup 212*b* in the second set of bra cups, which comprises at least a second pair of bra cup sizes. In one example, the second pair of bra cup sizes comprises a C cup size and a D cup size. However, the second pair of bra cup sizes could instead include a B cup size and a C cup size; a B cup size, a C cup size, and a D cup size; a D cup size and a DD cup size; etc. In general, the second set of bra cups comprises at least a second pair of bra cup sizes that are larger than the first pair of bra cup sizes relative to a given band size. In other words, if the first pair of bra cup sizes includes an A cup size and a B cup size, then the second pair of bra cup sizes includes at least a C cup size and a D cup size. If the first pair of bra cup sizes includes an AA cup size and an A cup size, then the second pair of bra cup sizes comprises at least a B cup size and a C cup size. The bra cup 212*b* has a curved bottom edge 218, a neckline edge 220, and an underarm edge 222. As shown, the inner face 330 of the bra cup 212*b* has a second padded area 232 having a second shape that is different from the first shape of the first padded area 132. The second padded area 232 has a lower edge 234 that is offset from and follows the curved bottom edge 218 of the bra cup 212*b*, an upper edge 238 that is substantially straight, and two convex corners 240, 242 connecting the lower edge 234 to the upper edge 238 on either side of the second padded area 232. As shown in FIG. 5, the more or less straight upper edge 238 of the second padded area 232 is generally perpendicular to the axis along which the heights of the bra cup and the padded area are measured. In another example, the upper edge 238 of the second padded area 232 is slightly concave or convex. In the present example, the two convex corners 240, 242 are radiused, but they could have a different shape.

The lower edge 234 of the second padded area 232 may be offset from the curved bottom edge 218 of the bra cup 212*b* by about 0.5-0.75 inch. The convex corner 240 of the second padded area 232 may be offset from the underarm edge 222 of the bra cup 212*b* by about 0.5-1 inch. The upper edge 238 of the second padded area 232 may be offset from the neckline edge 220 by about 2-4 inches, measured along the axis shown in FIG. 5.

Referring additionally to FIG. 5, according to the present disclosure, the second padded area 232 has a height H2 that is at least a second percentage of a cup height HC of the bra cup 212*b*. The heights H2 and HC are measured along the axis shown in FIG. 5, which axis is more or less parallel to the underarm edge 222 of the bra cup 212*b*, although other axes could be used in other examples. The height measurements are taken generally midway across the bra cup 212*b*, at the location where the second padded area 232 has its maximum height. In one example, the second percentage is about 40%. In a more specific example, the second percentage is between about 40% and about 42% of the height HC of the second bra cup 212*b*. In one example, the height HC of the bra cup 212*b* used in the denominator to calculate the second percentage excludes the flange 219 (FIG. 3) at the curved bottom edge 218 (i.e., the portion of the bra cup 212*b* to which the underwire is attached). In other examples, the height HC of the bra cup 212*b* in the denominator includes the flange 219. The height of the bra cup 212*b* and the height of the second padded area 232 can both be measured in plan, or can instead be measured taking into account the curvature of one or both of the second padded area 232 and the bra cup 212*b*. In one example in which the measurements take into account the curvature of the bra cup 212*b*, the height HC of the bra cup 212*b* is measured on the outer face of the bra cup 212*b*, but in another example the height HC is measured on the inner face 230 of the bra cup 212*b*.

Although only the left bra cup 212*b* is described herein, it should be understood that the right bra cup is a mirror image.

Further, according to the present disclosure, the inner face 230 of each bra cup in the second set of bra cups has the second padded area 232 having the second shape that is different from the first shape of the padded area 232 in the first set of bra cups. Each bra cup in the second set of bra cups has a curved bottom edge 218, a neckline edge 220, and an underarm edge 222. The second padded area 232 has the lower edge 234 that is offset from and follows the curved bottom edge 218, the upper edge 238 that is substantially straight, and the two convex corners 240, 242 connecting the lower edge 234 to the upper edge 238 on either side of the second padded area 232. That is, each bra cup in the second set of bra cups, whether it be (for example) a C cup or a D cup, has the second padded area 232 having the second shape, across all band sizes. In each cup in the second set of bra cups, the second padded area 232 has a height H2 that is at least the second percentage of the cup height of the bra cup. This means that in a C size cup associated with a given band size, the actual measurement of the height of the second padded area 232 might be smaller than the actual measurement of the height H2 of the second padded area 232 in a D size cup associated with the same band size, due to the difference in overall height of a C cup versus a D cup when used with the same band size.

For each bra cup in the second set of bra cups, the second percentage of the cup height for the second set of bra cups is less than the first percentage of the cup height for the first set of bra cups. Furthermore, the height H2 of the second padded area 232 on the inner face 230 of each bra cup 212*b* in the second set of bra cups is less than the first percentage of the cup height that is used for the first set of bra cups. That is, and by way of example only, if the first padded area 132 in each of the bra cups in the first set of bra cups has a height H1 that is about 53-56% of the height of the first bra cup, then the second padded area 232 in each of the bra cups in the second set of bra cups has a height H2 that is less than 53% of a height of the second bra cup in the second set.

It should be noted that the second percentage of the height of the bra cup need not be the same for all cup and/or band sizes forming the second set of bra cups in the collection. For example, the second padded area 232 may have a height that is 42% of the height of a 36C cup, but 41% of the height of a 38C cup. The second padded area 232 may have a height that is 41% of the height of a 36D cup, but 40% of a height of a 38D cup.

FIG. 4 shows the inner face 330 of an exemplary bra cup 312*b* in the third set of bra cups, which comprises at least a third pair of bra cup sizes. In one example, the third pair of bra cup sizes comprises a DD cup size and a DDD cup size. However, the third pair of bra cup sizes could instead include a C cup size and a D cup size; a D cup size, a DD cup size, and a DDD cup size; a DDD cup size and a DDDD cup size; etc. In general, the third set of bra cups comprises at least a third pair of bra cup sizes that are larger than the second pair of bra cup sizes relative to the given band size. In other words, if the second pair of bra cup sizes includes an C cup size and a D cup size, then the third pair of bra cup sizes comprises at least a DD cup size and a DDD cup size. If the second pair of bra cup sizes includes an B cup size and a C cup size, then the third pair of bra cup sizes comprises at least a D cup size and a DD cup size. The bra cup 312*b* has a curved bottom edge 318, a neckline edge 320, and an underarm edge 322. As shown, the inner face 330 of the bra cup 312*b* has a third padded area 332 having a third shape that is that is different from the first and second shapes of the respective first and second padded areas 132, 232. The third padded area 332 has a lower edge 334 that is offset from and follows the curved bottom edge 318 of the bra cup 312*b*, a concave upper edge 338 that has a smaller radius of curvature than a radius of curvature of the lower edge 334, and two convex corners 340, 342 connecting the lower edge 334 to the upper edge 338 on either side of the third padded area 332. In other examples, the upper edge 338 of the third padded area 332 may have a radius that is greater than that of the lower edge 334 (i.e., the upper edge 338 may be shallower than shown here). In the present example, the two convex corners 340, 342 are radiused, but they could have a different shape.

The lower edge 334 of the third padded area 332 may be offset from the curved bottom edge 318 of the bra cup 312*b* by about 0.5-0.75 inch. The convex corner 340 of the third padded area 332 may be offset from the underarm edge 322 of the bra cup 312*b* by about 0.5-1 inch. The upper edge 338 of the third padded area 332 may be offset from the neckline edge 320 of the bra cup 312*b* by about 4-6 inches, measured along the axis shown in FIG. 5.

Referring additionally to FIG. 5, according to the present disclosure, the third padded area 332 has a height H3 that is at least a third percentage of a cup height HC of the bra cup 312*b*. The heights H3 and HC are measured along the axis shown in FIG. 5, which axis is more or less parallel to the underarm edge 322 of the bra cup 312*b*, although other axes could be used in other examples. The height measurements are taken generally midway across the bra cup 312*b*, at the location where the third padded area 332 has its maximum height. In one example, the third percentage is about 20%. In a more specific example, the third percentage is between about 21% and about 23% of the height HC of the third bra cup 312*b*. In one example, the height HC of the bra cup 312*b* used in the denominator to calculate the third percentage excludes the flange 319 (FIG. 4) at the curved bottom edge 318 (i.e., the portion of the bra cup 312*b* to which the underwire is attached). In other examples, the height HC of the bra cup 312*b* in the denominator includes the flange 319. The height of the bra cup 312*b* and the height of the third padded area 332 can both be measured in plan, or can instead be measured taking into account the curvature of one or both of the third padded area 332 and the bra cup 312*b*. In one example in which the measurements take into account the curvature of the bra cup 312*b*, the height HC of the bra cup 312*b* is measured on the outer face of the bra cup 312*b*, but in another example the height HC is measured on the inner face 330 of the bra cup 312*b*.

Although only the left bra cup 312*b* is described herein, it should be understood that the right bra cup is a mirror image.

Further, according to the present disclosure, the inner face of each bra cup in the third set of bra cups has the third padded area 332 having the third shape that is different from the first and second shapes of the padded areas 132, 232 in the respective first and second sets of bra cups. Each bra cup in the third set of bra cups has a curved bottom edge 318, a neckline edge 320, and an underarm edge 322. The third padded area 332 has a lower edge 334 that is offset from and follows the curved bottom edge 318 of the bra cup 312*b*, a concave upper edge 338 that has a smaller radius of curvature than a radius of curvature of the lower edge 334 of the bra cup 312*b*, and two convex corners 340, 342 connecting the lower edge 334 to the upper edge 338 on either side of the third padded area 332. That is, each bra cup in the third set of bra cups, whether it be (for example) a DD cup or a DDD cup, has the third padded area 332 having the third shape, across all band sizes. In each bra cup in the third set of bra cups, the third padded area 332 has a height H3 that is at least the third percentage of the cup height HC of the bra cup. This means that in a DD size cup associated with a given band size, the actual measurement of the height H3 of the third padded area 332 might be smaller than the actual measurement of the height H3 of the third padded area 332 in a DDD size cup associated with the same band size, due to the difference in overall height of a DD cup versus a DDD cup when used with the same band size.

For each bra cup in the third set of bra cups, the third percentage of the cup height HC is less than the second percentage of the cup height for the second set of bra cups. Furthermore, the height of the third padded area 332 on the inner face 330 of each bra cup 312*b* in the third set of bra cups is less than the second percentage of the cup height that is used for the second set of bra cups. That is, and by way of example only, if the second padded area 232 in each of the bra cups in the second set of bra cups has a height that is about 40-42% of the height of the second bra cup, then the third padded area 332 in each of the bra cups in the third set of bra cups has a height that is less than 40% of a height of the bra cup in the third set.

It should be noted that the third percentage of the height of the bra cup need not be the same for all cup and/or band sizes forming the third set of bra cups in the collection. For example, the third padded area 332 may have a height that is 23% of the height of a 38DD cup, but 21% of the height of a 40DD cup. The third padded area 332 may have a height that is 23% of the height of a 36DDD cup, but 21% of a height of a 38DDD cup.

FIG. 5 shows an inner face of a bra with each of the first, second, and third padded areas 132, 232, 332 shown thereupon, it being understood that in actuality only one of the padded areas would be provided on each bra cup 12*a*, 12*b*. According to the present disclosure, the first and second padded areas 132, 232 project from the inner face 130, 230 of the respective bra cup 112*b*, 212*b* in the first and second sets of bra cups. So too does the third padded area 332 project from the inner face 330 of the bra cup 312*b* in the third set of bra cups. In other words, the padded areas 132, 232, 332 are bumps on the inner faces 130, 230, 330 of the bra cups 112*b*, 212*b*, 312*b* that contact the wearer's skin when the bra is worn. The padded areas 132, 232, 332 displace the tissue of the breast and push it up to provide lift to her cleavage. Because the first padded area 132 has the greatest height H1 relative to cup height HC (i.e., the first padded area 132 is the largest) it provides the most lift, which is desirable for wearers who have the least breast volume. Because the third padded area 332 has the least height H3 relative to cup height HC (i.e., the third padded area 332 is the smallest) it provides the least lift, which is desirable for wearers who have the most breast volume. The second padded area 232 has a height H2 relative to cup height HC that is between the heights of the first and third padded areas 132, 332 and thus provides a moderate amount of lift.

As noted hereinabove, the second percentage of the cup height HC is less than the first percentage of the cup height HC, and the height H2 of the second padded area 232 on the inner face 230 of each bra cup in the second set of bra cups is less than the first percentage of the cup height. That is, the second height H2 is less than the first height H1. In one example, each bra cup in the first set of bra cups has the first padded area 132 having the first shape and the first padded area 132 has a height H1 that is between a first percentage and a second percentage of a cup height HC of each bra cup in the first set of bra cups. An inner face 130 of each bra cup in the second set of bra cups has a second padded area 232 having a second shape that is different from the first shape, and the second padded area 232 has a height H2 that is between a third percentage and a fourth percentage of a cup height HC of each bra cup in the second set of bra cups. According to the present disclosure, and in order to provide a different lift between the first and second sets of bra cups, the third percentage of the cup height, which is the maximum for H2, is less than the second percentage of the cup height, which is the minimum for H1. Further, the inner face of each bra cup in the third set of bra cups has a third padded area 332 having a third shape that is different from the first and second shapes, and the third padded area 332 has a height H3 that is between a fifth percentage and a sixth percentage of a cup height HC of each bra cup in the third set of bra cups. According to the present disclosure, the fifth percentage of the cup height, which is the maximum for H3, is less than the fourth percentage of the cup height, which is the minimum for H2.

In one example, the first and second percentages (i.e., the maximum and minimum for H1) are between about 50% and about 60%, the third and fourth percentages (i.e., the maximum and minimum for H2) are between about 40% and about 50%, and the fifth and sixth percentages (i.e., the maximum and minimum for H3) are between about 20% and about 30%. In one example, there is a difference of at least 10% between the second percentage (the minimum for H1) and the third percentage (the maximum for H2), and there is a difference of at least 15% between the fourth percentage (the minimum for H2) and the fifth percentage (the maximum for H3). In a particular example, the first percentage (the maximum for H1) is about 56%, the second percentage (the minimum for H1) is about 53%, the third percentage (the maximum for H2) is about 42%, the fourth percentage (the minimum for H2) is about 40%, the fifth percentage (the maximum for H3) is about 23%, and the sixth percentage (the minimum for H3) is about 21%.

For each bra in the collection, the padded area 132, 232, 332 may be formed by providing extra thickness to the bra cup beyond that in a reminder of the bra cup. For instance, if the bra cup is made of fabric and foam layers of a given total thickness, the padded area 132, 232, 332 may have a thickness greater than the given total thickness. The thickness of the padded area 132, 232, 332 may be graduated, such that the thickness increases from the given thickness of the remainder of the bra cup at the perimeter of the padded area 132, 232, 332, to a maximum thickness at the center of the padded area 132, 232, 332. This is shown by the contour lines in FIGS. 2-4. In one example, the maximum thickness of the first padded area 132 is about 0.5 inch; the maximum thickness of the second padded area 232 is about 0.38 inch; and the maximum thickness of the third padded area 332 is about 0.25 inch. Thus, it can be seen that not only does the relative height of the padded area change from one set of bra cups to another, but the maximum thickness changes as well. In the example above, the maximum thickness decreases ⅛ inch from the first set of bra cups to the second, and from the second set of bra cups to the third.

The padded areas 132, 232, 332 can be formed using foam, fiber fill, fabric, and/or a bladder filled with air, gel, or other known material. In the present example, the padded areas 132, 232, 332 are formed by providing more foam than that provided in the remainder of the bra cup. To provide more foam in the padded area, an extra layer of foam ("cookie") can be provided, a layer of foam can be shaved to leave a thicker area, a larger gap can be provided between an upper and lower mold such that the foam is compressed less in the gap than elsewhere, or the pad can be injection molded or additive printed to a desired geometry. In the present example, the first and second padded areas 132, 232 are formed by providing a cookie of foam having the size and shape of the padded area into the layers of the bra cup 112*b*, 212*b* prior to molding. For example, the bra cups 112*b*, 212*b* in each of the first and second sets of bra cups can have an outer layer of fabric, and outer layer of foam, a foam cookie, an inner layer of foam, and an inner layer of fabric at the padded area 132, 232. In the present example, the third padded area 332 is formed by providing a larger gap between the upper and lower molds used to form the bra cup 312*b*, which larger gap has the size and shape of the third padded area 332, and a smaller gap between the molds for the remainder of the bra cup 312*b*. For example, the bra cup 312*b* in the third set of bra cups may have an outer layer of fabric, a single layer of foam, and an inner layer of fabric at the padded area 332.

In the present description, certain terms have been used for brevity, clarity, and understanding. No unnecessary limitations are to be implied therefrom beyond the requirement of the prior art because such terms are used for descriptive purposes only and are intended to be broadly construed. The different assemblies described herein may be used alone or in combination with other systems. Various equivalents, alternatives, and modifications are possible within the scope of the appended claims.

What is claimed is:

1. A collection of bras comprising:

a first group of bras, each bra in the first group of bras comprising bra cups selected from a first set of bra cups comprising at least a first pair of bra cup sizes, an inner face of each bra cup in the first set of bra cups having a first padded area having a first shape, the first padded area having a height that is at least a first percentage of a cup height of each bra cup in the first set of bra cups; and a second group of bras, each bra in the second group of bras comprising bra cups selected from a second set of bra cups comprising at least a second pair of bra cup sizes that are larger than the first pair of bra cup sizes relative to a given band size, an inner face of each bra cup in the second set of bra cups having a second padded area having a second shape that is different from the first shape, the second padded area having a height that is at least a second percentage of a cup height of each bra cup in the second set of bra cups;

wherein the second percentage of the cup height is less than the first percentage of the cup height; and wherein the height of the second padded area on the inner face of each bra cup in the second set of bra cups is less than the first percentage of the cup height.

2. The collection of bras of claim 1, wherein:

each bra cup in the first set of bra cups has a curved bottom edge, a neckline edge, and an underarm edge; and the first padded area has a lower edge that is offset from and follows the curved bottom edge, an outer edge that is offset from and follows the underarm edge, and a convex upper edge connecting the lower edge and the outer edge of the first padded area.

3. The collection of bras of claim 2, wherein:

each bra cup in the second set of bra cups has a curved bottom edge, a neckline edge, and an underarm edge; and the second padded area has a lower edge that is offset from and follows the curved bottom edge, an upper edge that is substantially straight, and two convex corners connecting the lower edge to the upper edge on either side of the second padded area.

4. The collection of bras of claim 1, further comprising a third group of bras, each bra in the third group of bras comprising bra cups selected from a third set of bra cups comprising at least a third pair of bra cup sizes that are larger than the second pair of bra cup sizes relative to the given band size, an inner face of each bra cup in the third set of bra cups having a third padded area having a third shape that is different from the first and second shapes, the third padded area having a height that is at least a third percentage of a cup height of each bra cup in the third set of bra cups;

wherein the third percentage of the cup height is less than the second percentage of the cup height; and wherein the height of the third padded area on the inner face of each bra cup in the third set of bra cups is less than the second percentage of the cup height.

5. The collection of bras of claim 4, wherein the first pair of bra cup sizes comprises an A cup size and a B cup size and the second pair of bra cup sizes comprises a C cup size and a D cup size.

6. The collection of bras of claim 5, wherein the third pair of bra cup sizes comprises a DD cup size and a DDD cup size.

7. The collection of bras of claim 4, wherein:

each bra cup in the third set of bra cups has a curved bottom edge, a neckline edge, and an underarm edge; and the third padded area has a lower edge that is offset from and follows the curved bottom edge, a concave upper edge that has a smaller radius of curvature than a radius of curvature of the lower edge, and two convex corners connecting the lower edge to the upper edge on either side of the third padded area.

8. The collection of bras of claim 4, wherein the first percentage is about 50%, the second percentage is about 40%, and the third percentage is about 20%.

9. The collection of bras of claim 8, wherein the first percentage is between about 53% and about 56%, the second percentage is between about 40% and about 42%, and the third percentage is between about 21% and about 23%.

10. The collection of bras of claim 1, wherein the first percentage is about 50% and the second percentage is about 40%.

11. The collection of bras of claim 10, wherein the first percentage is between about 53% and about 56% and the second percentage is between about 40% and about 42%.

12. The collection of bras of claim 1, wherein the first and second padded areas project from the inner face of the respective bra cup in the first and second sets of bra cups.

13. A collection of bras comprising:

a first group of bras, each bra in the first group of bras comprising bra cups selected from a first set of bra cups comprising at least a first pair of bra cup sizes, an inner face of each bra cup in the first set of bra cups having a first padded area having a first shape, the first padded area having a height that is between a first percentage and a second percentage of a cup height of each bra cup in the first set of bra cups; and a second group of bras, each bra in the second group of bras comprising bra cups selected from a second set of bra cups comprising at least a second pair of bra cup sizes that are larger than the first pair of bra cup sizes relative to a given band size, an inner face of each bra cup in the second set of bra cups having a second padded area having a second shape that is different from the first shape, the second padded area having a height that is between a third percentage and a fourth percentage of a cup height of each bra cup in the second set of bra cups;

wherein the third percentage of the cup height is less than the second percentage of the cup height.

14. The collection of bras of claim 13, wherein the first and second percentages are between about 50% and about 60%, and the third and fourth percentages are between about 40% and about 50%.

15. The collection of bras of claim 14, wherein the first percentage is about 56%, the second percentage is about 53%, the third percentage is about 42%, and the fourth percentage is about 40%.

16. The collection of bras of claim 13, further comprising a third group of bras, each bra in the third group of bras comprising bra cups selected from a third set of bra cups comprising at least a third pair of bra cup sizes that are larger than the second pair of bra cup sizes relative to the given band size, an inner face of each bra cup in the third set of bra cups having a third padded area having a third shape that is different from the first and second shapes, the third padded area having a height that is between a fifth percentage and a sixth percentage of a cup height of each bra cup in the third set of bra cups;

wherein the fifth percentage of the cup height is less than the fourth percentage of the cup height.

17. The collection of bras of claim 16, wherein the first and second percentages are between about 50% and about 60%, the third and fourth percentages are between about 40% and about 50%, and the fifth and sixth percentages are between about 20% and about 30%.

18. The collection of bras of claim 16, wherein there is a difference of at least 15% between the fourth percentage and the fifth percentage.

19. The collection of bras of claim 13, wherein the first pair of bra cup sizes comprises an A cup size and a B cup size and the second pair of bra cup sizes comprises a C cup size and a D cup size.

20. The collection of bras of claim 13, wherein there is a difference of at least 10% between the second percentage and the third percentage.

* * * * *